US010621864B1

(12) United States Patent
Graham

(10) Patent No.: US 10,621,864 B1
(45) Date of Patent: Apr. 14, 2020

(54) V2X VEHICLE PULLOUT ADVISORY SYSTEM

(71) Applicants: DENSO International America, Inc., Southfield, MI (US); DENSO CORPORATION, Kariya (JP)

(72) Inventor: Susan M. Graham, Solana Beach, CA (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 0 days.

(21) Appl. No.: 16/142,405

(22) Filed: Sep. 26, 2018

(51) Int. Cl.
*G08G 1/09* (2006.01)
*G08G 1/0965* (2006.01)
*G08G 1/0967* (2006.01)

(52) U.S. Cl.
CPC ..... *G08G 1/0965* (2013.01); *G08G 1/096791* (2013.01)

(58) Field of Classification Search
CPC ..... G08G 1/0965; G08G 1/144; G08G 1/147; G08G 1/166; G08G 1/04; G08G 1/0112; G05D 1/02; B60Q 1/00; H04W 4/046; H04W 4/04
USPC ..... 340/905
See application file for complete search history.

(56) References Cited

U.S. PATENT DOCUMENTS

| | | | | |
|---|---|---|---|---|
| 10,210,756 | B2 * | 2/2019 | Arunachalam | G08G 1/0965 |
| 10,262,538 | B1 * | 4/2019 | Milovich | G08G 1/144 |
| 10,274,274 | B2 * | 4/2019 | Kwon | F41A 9/68 |
| 2013/0083679 | A1 * | 4/2013 | Krishnaswamy | G08G 1/093 370/252 |
| 2019/0043364 | A1 * | 2/2019 | Jumpertz | B60W 30/18163 |

* cited by examiner

*Primary Examiner* — Toan N Pham
(74) *Attorney, Agent, or Firm* — Brooks Kushman, P.C.

(57) ABSTRACT

A route-advisory system for a first vehicle may include a memory configured to maintain map data indicating at least one road condition; a controller configured to receive remote vehicle data from at least one other vehicle, the remote vehicle data including a remote vehicle location, and provide route instructions in response to the remote vehicle location indicating that the at least one other vehicle is trailing the first vehicle within a predefined distance and that the at least one road condition indicates the first vehicle and the at least one other vehicle are traveling on a road having a pullout within a predefined distance ahead of the at least one other vehicle.

18 Claims, 4 Drawing Sheets

V2X VEHICLE PULLOUT ADVISORY SYSTEM

TECHNICAL FIELD

Disclosed herein are V2X vehicle pullout advisory systems.

BACKGROUND

Vehicle-to-vehicle (V2V) and vehicle-to-infrastructure (V2I) communication, collectively referred as V2X, are becoming more prevalent in today's vehicles. Data may be shared across vehicles and coordinated to provide for better user experiences.

SUMMARY

A route-advisory system for a first vehicle may include a memory configured to maintain map data indicating at least one road condition; a controller configured to receive remote vehicle data from at least one other vehicle, the remote vehicle data including a remote vehicle location, and provide route instructions in response to the remote vehicle location indicating that the at least one other vehicle is trailing the first vehicle within a predefined distance and that the at least one road condition indicates the first vehicle and the at least one other vehicle are traveling on a road having a pullout within a predefined distance ahead of the at least one other vehicle.

A route-advisory system for a first vehicle may include a memory configured to maintain map data indicating at least one road condition, and a controller configured to receive remote vehicle data from at least one other vehicle, the remote vehicle data indicating the presence of another vehicle along the route of the vehicle, and provide route instructions in response to the at least one road condition indicating a pullout located along the route.

A route-advisory system for a vehicle traveling along a route may include a memory and a controller configured to receive map data indicating at least one road condition of the vehicle route, receive remote vehicle data indicating a presence of at least one other vehicle traveling ahead of the vehicle, and provide route instructions to the other vehicle in response to the map data indicating a pullout along the vehicle route.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Vehicles often travel on two-lane roads where passing may be prohibited or difficult due to limited visibility caused by curves and inclines of the road. For example, a vehicle traveling uphill on a curvy mountain road may be unable to pass a motorhome or truck due to the limited visibility ahead, and/or prohibited passing. Due to this, traffic may often build up behind a slower moving vehicle on such roads.

Fortunately, some of these roads may include one or more pullouts, where slower vehicles may pull off the road and allow faster moving vehicles to pass. Often times, however, drivers of the slower moving vehicles fail to use these pullouts. The drivers may either be unaware of the queue of vehicles behind them, or be unaware of an upcoming pullout.

Disclosed herein is a pullout advisory system configured to provide an advisory to a driver of a vehicle of an upcoming pullout. The advisory may include a distance to a next pullout, and/or alert the driver as to trailing vehicles behind the slower moving vehicle. The advisory system may reduce the number of unsafe passing attempts. When the advisory system detects a slower moving vehicle is on a two-lane road, is impeding other vehicles, and pullouts are available, the system may advise the driver to use the next pullout. Such information may be provided to the application via map data, as well as vehicle-to-vehicle (V2V) or vehicle-to-everything (V2X) communication. Remote vehicles, or the vehicle trailing the slower moving vehicle, may instruct the slower moving vehicle of their location. The remote vehicles may also instruct the system within the slower moving vehicle to instruct the driver to use the next pullout.

Figure 1:
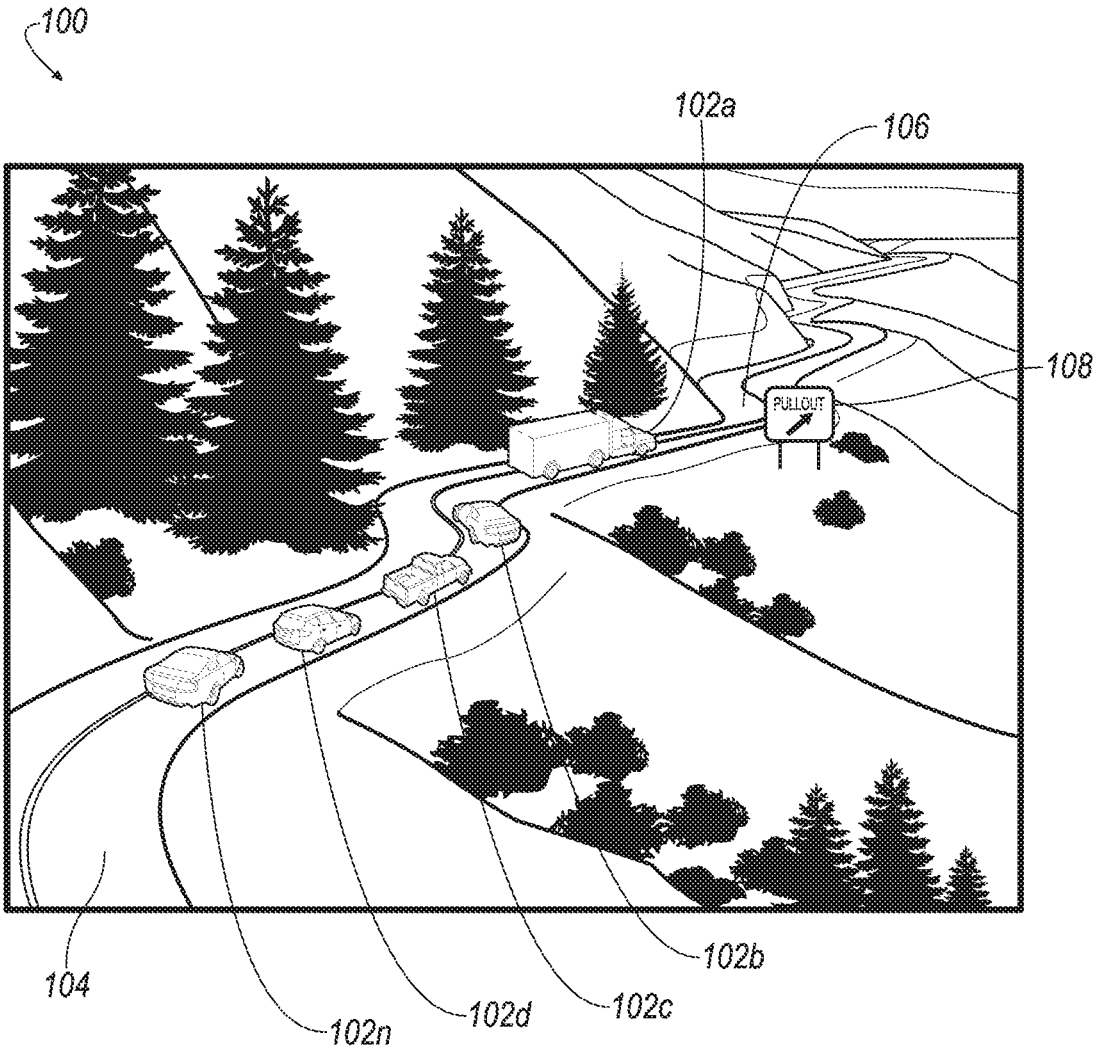
FIG. 1 illustrates an example V2X vehicle pullout advisory system.

FIG. 1 illustrates an example V2X vehicle pullout advisory system 100 for a vehicle 102*a*. The pullout advisory system 100 includes a first vehicle 102*a*. The first vehicle 102*a* may be a host, primary, or a slow-moving vehicle such as a three-axle vehicle, semi-truck, cargo vehicle, or other type of vehicle that may move slower than a light motor vehicle such as sedans, vans, cross-overs, etc. The first vehicle 102*a* may be an especially slower moving than other vehicles on two-lane roads, curvy roads, etc.

The first vehicle 102*a* may be followed by at least one second vehicle 102*b-n*. The at least one second vehicle 102*b-n* may be a vehicle that may not be considered a slow-moving vehicle. For example, the second vehicle 102*b-n* may be a passenger vehicle having two axle that may be capable of safely traveling along a road at faster speeds than that of the first vehicle 102*a*.

The vehicles 102 may travel on a road 104 following a vehicle route 106. The road 104 may have certain road characteristics such as a number of lanes, as well as whether the road includes pullouts. The road 104, as shown in FIG. 1, may be a two-lane road having one lane intended for traveling in each direction. The road 104 may also be any number of lanes, including one-lane, three-lane, four-lane, etc.

The pullout 108 may be an area along the vehicle route 106 and adjacent to the road 104 where the vehicle 102*a* may pull over during driving to allow other vehicles to pass. The pullout 108 may be a strip of road long enough to allow the first vehicle 102*a*, for example, to pull onto and drive for a certain distance at a slower speed while the second vehicles 102*b-n* pass the first vehicle 102*a*.

Figure 2:
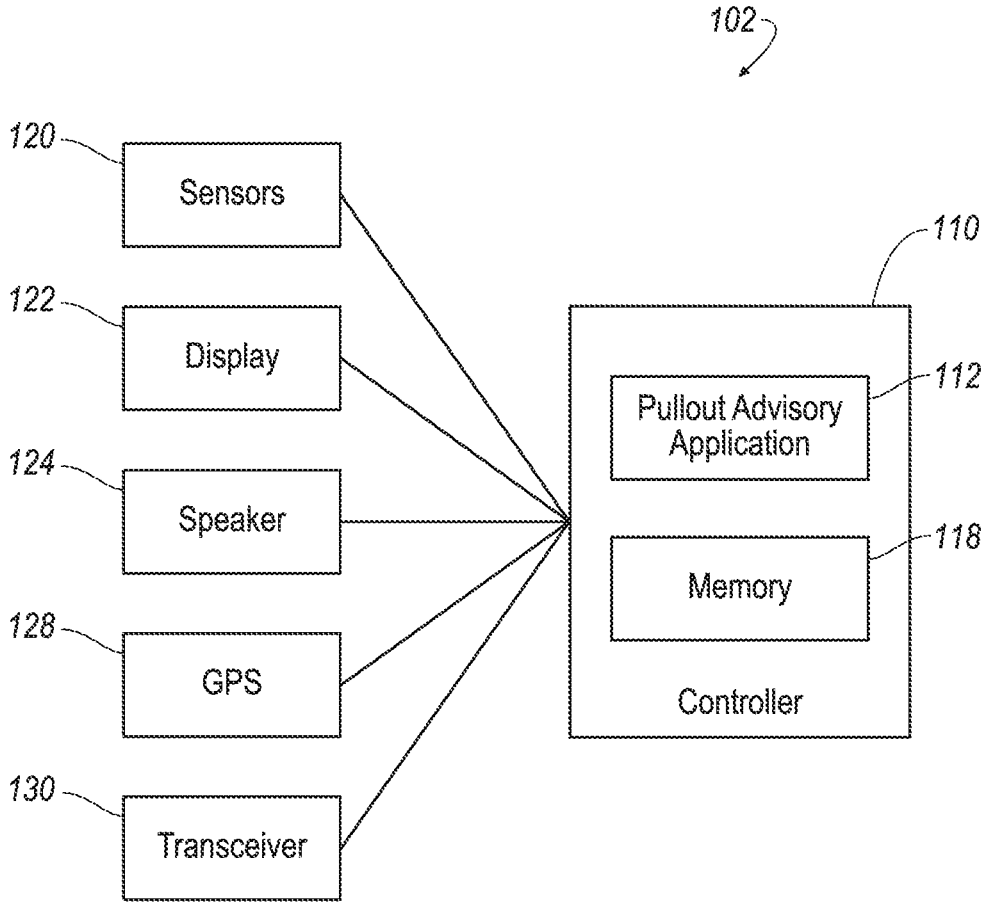
FIG. 2 illustrates an example block diagram for the pullout advisory system of each vehicle.

FIG. 2 illustrates an example block diagram for the pullout advisory system of each vehicle 102. Each vehicle may include a controller 110 having a pullout advisory system 112. The controller 110 may be a vehicle controller such as an electronic control unit (ECU). The controller 110 may be embodied in a processor configured to carry out instructions for the methods and systems described herein. The controller 110 may include a memory 118, as well as other components specific processing within the vehicle. The controller 110 may be one or more computing devices such as a computer processor, microprocessor, or any other device, series of devices or other mechanisms capable of performing the operations discussed herein. The memory 118 may store instructions and commands, as well as map data. The instructions may be in the form of software, firmware, computer code, or some combination thereof. The memory 118 may be in any form of one or more data storage devices, such as volatile memory, non-volatile memory, electronic memory, magnetic memory, optical memory, or any other form of data storage device.

The vehicle 102 may include a plurality of sensors 120. The sensors 120 may include various cameras, LIDAR sensors, radar sensors, ultrasonic sensors, or other sensors for detecting information about the surroundings of the vehicle, including, for example, other vehicles, lane lines, guard rails, objects in the roadway, buildings, pedestrians, etc. Each of the sensors 120 may be arranged at a location around the vehicle 102.

The sensors 120 may be in communication with the pullout advisory system 112. The advisory system 112 may use the data received from the sensors 120 to determine the route characteristics such as the number of lanes of the road 104 and whether a pullout 106 is present along the route based on the detected vehicle surroundings.

The vehicle 102 may include a vehicle display 122 within the vehicle center console. The display 122 may be a heads-up display, a dash board display, etc. The display 122 may display certain user interfaces and images related to vehicle features supplied to the controller 110. For example, the display 122 may display navigation commands to the driver.

The vehicle 102 may also include a speaker 124 configured to supply audio output to the vehicle cabin. The speaker 124 may receive the audio outputs from the controller 110 and may include instructions, such as the navigation commands, in addition to or in alternative to the displayed navigation commands on the vehicle display 122. These navigation commands may include route information or road conditions. In one example, as discussed in more detail below, the commands may include instructions at the first vehicle 102*a* for the first vehicle 102*a* to take an upcoming pullout so that the second vehicles 102*b-n* may pass the slower traveling first vehicle 102*a*.

The vehicle 102 may include a global navigation satellite system (GNSS) receiver 128. The GNS 128 may provide a current position of the vehicle to the controller 110. In some circumstances, the GNS 113 may be utilized to determine a speed that the vehicle is traveling. The system 100 may also include a vehicle speed sensor (not shown) that detects or determines a current speed that the vehicle is traveling. The system 100 may also include a compass or three-dimensional (3D) gyroscope that detects or determines a current direction of the vehicle. Map data may be stored in the memory 118. GNS The map data may include information that may be utilized with advanced driver assistance system (ADAS) and the pullout advisory system 112. Such map data information may include the road conditions including detailed lane information, slope information, road curvature data, lane marking-characteristics, pullout locations, etc. Such map data may be utilized in addition to traditional map data such as road names, road classification, speed limit information, etc. The controller 101 may utilize data from the GNS 128, over-the-air messages, as well data/information from the gyroscope, vehicle speed sensor, and map data, to determine a location or current position, speed and heading of the vehicles 102.

The vehicle 102 may also include a transceiver 130 configured to send and receive wireless data between the vehicle 102 and external devices including infrastructures, vehicles, etc. This communication may include vehicle-to-vehicle (V2V), vehicle-to-infrastructure (V2I), vehicle-to-pedestrian (V2D), vehicle-to-device, vehicle-to-grid, and vehicle-to-everything (V2X). Such wireless communication may be facilitated by a wireless local area network (WLAN). Data may be transmitted over a 5.9 GHz frequency band. Other wireless communication protocols may be used to exchange data between vehicles such as a cellular network.

In the example shown in FIG. 1, the transceiver 130 may facilitate communication between the first vehicle 102*a* and the second vehicles 102*b-n* over the air from a dedicated short range communication (DSRC) roadside unit (RSU). The vehicles 102 may transmit information such as their respective speed, location and heading to the other vehicles 102. The pullout advisory application 112 may use this data to determine the relative position of the second vehicles 102*b-n* to the first vehicle 102*a* and vice-versa. The vehicles 102 may also share data that may be used to update the map data stored within the memory. For example, the map data may be updated to include various speed limits, road conditions such as number of lanes, etc. The data may also be acquired via pre-loaded broadcasts by roadside equipment. Updates from other vehicles may also be received.

Each of the vehicles 102 may include the components shown in FIG. 2. Additionally or alternatively, each vehicle may include a subject or additional components. In one example, the first vehicle 102*a* receives remote vehicle data from at least one of the second vehicles 102*b-n*. As explained above, this data may include additional map data, speed limit, pullout location information, as well as data regarding the specific vehicle 102. The remote vehicle data may be broadcast using basic safety messages (BSMs) containing the current position, speed, heading and other information about that remote vehicle. The first vehicle 102*a* may then use this information to determine whether using a pullout would be beneficial to the second vehicles 102*b-n* following the first vehicle 102*a*.

In another example, one of the remote vehicles 102*b-n* may receive vehicle data from the first vehicle 102*a* and may determine that the remote vehicles 102*b-n* may benefit from the first vehicle's use of an upcoming pullout 108. One of the remote second vehicles 102*b-n* may determine that the first vehicle 102*a* is within a predefined distance ahead of the second vehicle 102*b* (e.g., 1 approximately 1 mile) and in response, send a request to the first vehicle 102*a* requesting the first vehicle to take the next pullout 108.

Figure 3:
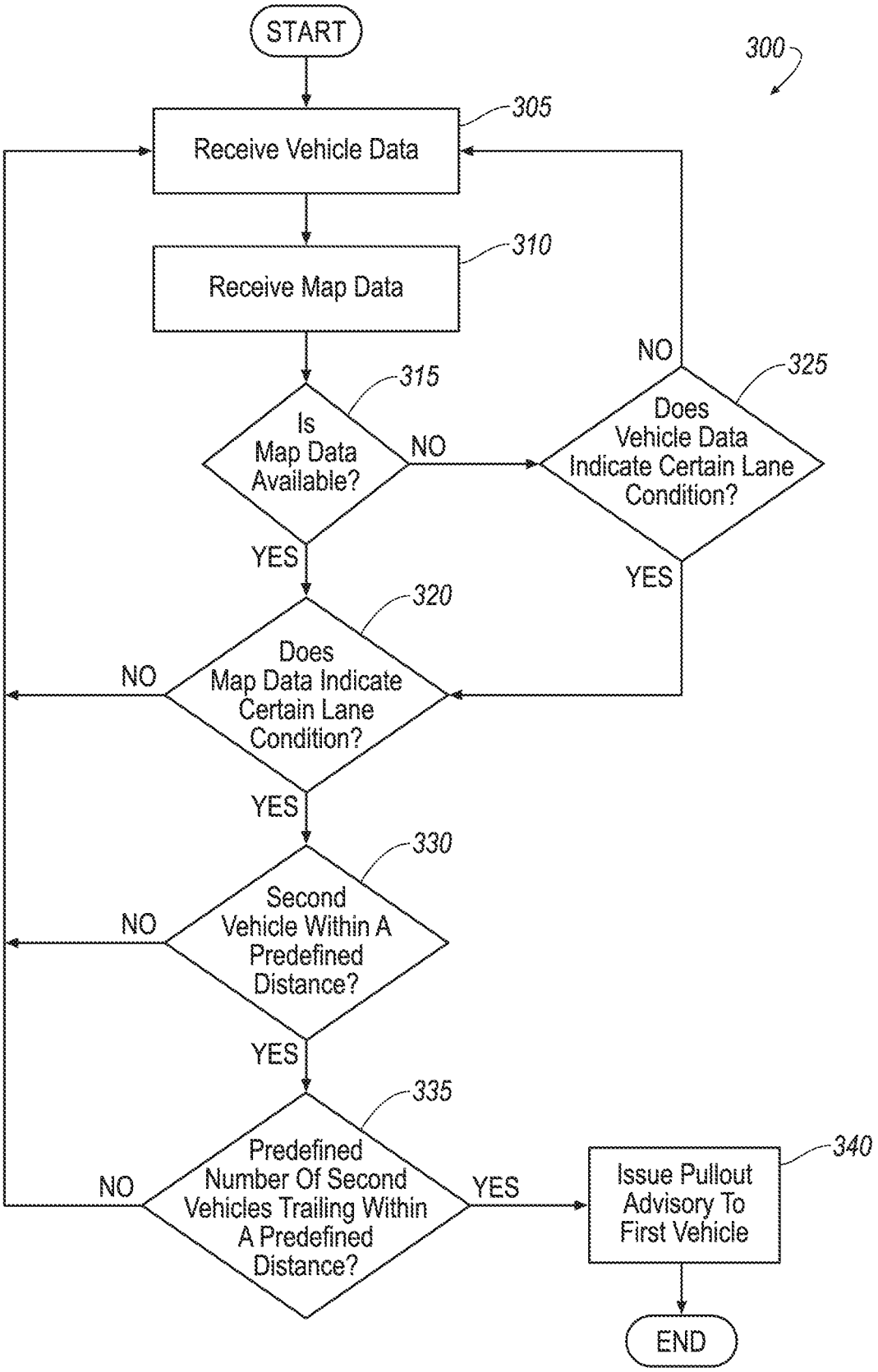
FIG. 3 illustrates an example process of the pullout advisory system at the first vehicle.

FIG. 3 illustrates an example process 300 of the pullout advisory system 100 at the first vehicle 102*a*. The process 300 begins at block 305 where the controller 110 of the first vehicle 102*a* may receive remote vehicle data from at least one of the second vehicles 102*b-n*. As explained, the remote vehicle data may include data about the second vehicles 102*b-n*, such as the current position, speed, and heading.

At block 310, the controller 110 of the first vehicle 102*a* may read map data 310 from the memory 118. The map data may include the current route and road conditions such as the number of lanes and whether pullouts are along the route.

At block 315, the controller 110 of the first vehicle 102*a* may determine whether the map data is available in the memory 118. If so, the process 300 proceeds to block 320. If not, the process 300 proceeds to block 325.

At block 320, the controller 110 of the first vehicle 102*a* may determine whether the map data indicates that the road 104 has a certain lane condition. In one example, the lane condition may be a lane threshold such as a certain amount of lanes. In one example, if the road is a two-lane road or less, than the condition may be met. In other examples, any road that could provide less than ideal passing conditions may quality. If the lane condition is met, the process 300 proceeds to block 330. If not, the process 300 returns to block 305.

In addition to the lane requirement, the controller 110 may also determine whether the map data indicates the presence of a pullout 108 along the route 106 within a predefined pullout distance of the first vehicle 102*a*. The predefined pullout distance may be approximately 5-10 miles.

At block 330, the controller 110 of the first vehicle 102*a* may determine whether the second vehicle 102*b-n* is within a predefined vehicle distance of the first vehicle 102*a*. The predefined vehicle distance may be approximately one ¼ of a mile, for example. If one of the second vehicles 102*b-n* is within the predefined vehicle distance of the first vehicle 102*a*, the process 300 may proceed to block 335. If not, the process 300 may return to block 305.

At block 335, the controller 110 of the first vehicle 102*a* may determine whether a predefined number of second vehicles 102*b-n* are trailing within the predefined vehicle distance of the first vehicle 102*a*. The predefined number may indicate a number of vehicles creating a back-up queue behind the slow moving first vehicle 102*a*. For example, the predefined number may be three, or more.

If a predefined number of second vehicles 102*b-n* are trailing within the predefined vehicle distance of the first vehicle 102*a*, the process 300 proceeds to block 340. If not, the process 300 returns to block 304.

At block 340, the controller 110 of the first vehicle 102*a* may issue a pullout advisory to the first vehicle 102*a* instructing the vehicle to use the next pullout. The pullout advisory may also include the distance to the next pullout. As explained above, the pullout advisory may include audio and/or visual instructions via the display 122 and speakers 124 within the first vehicle 102*a*.

At block 325, the controller 110 of the first vehicle 102*a* may determine whether the remote vehicle data includes data that indicates a certain lane condition. This may be determined based on data from the sensors 120 and remote vehicle data, as explained above.

Figure 4:
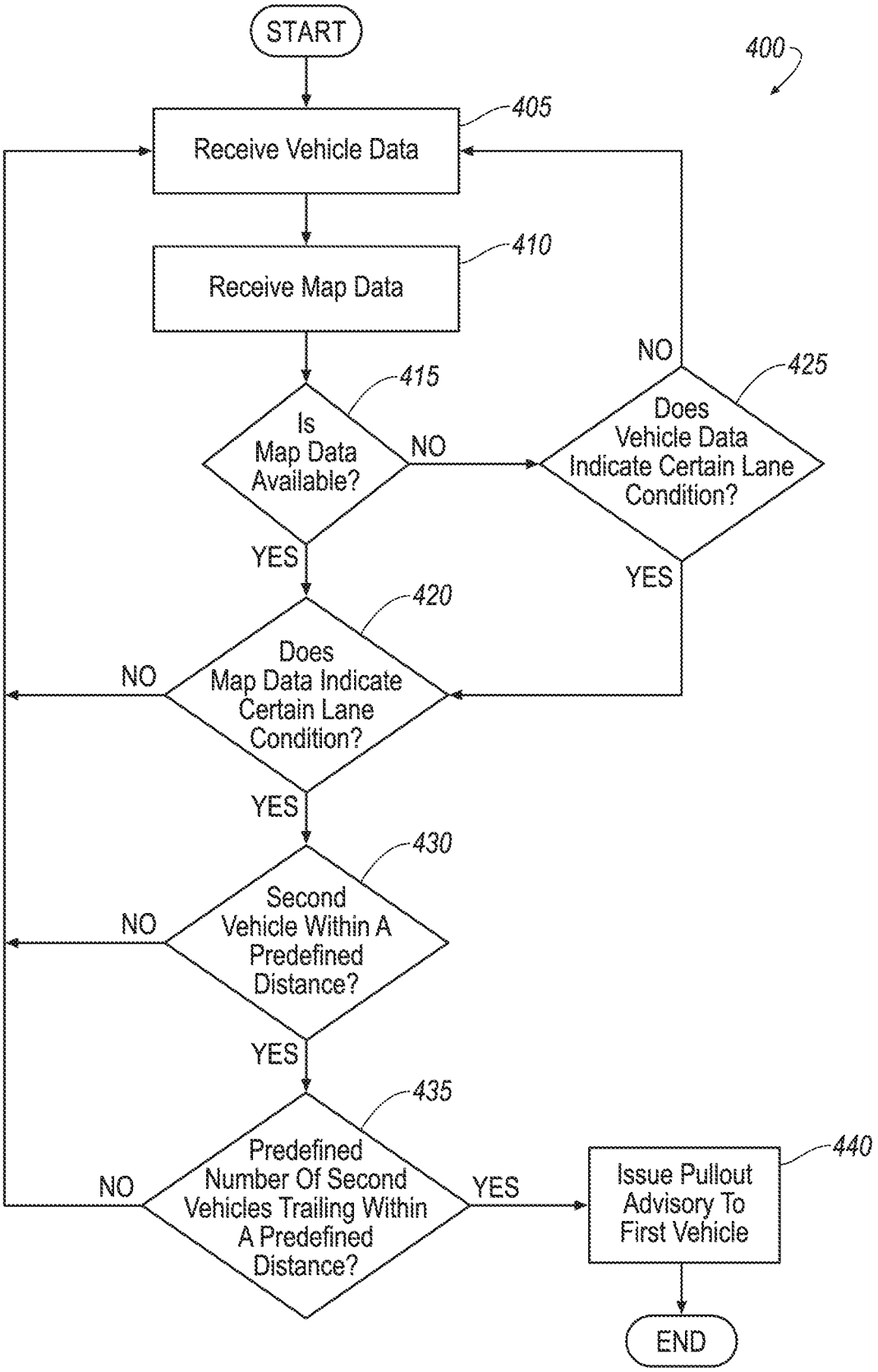
FIG. 4 illustrates an example process of the pullout advisory system at one of the second vehicles.

FIG. 4 illustrates an example process 400 of the pullout advisory system 100 at one of the second vehicles 102*b-n*. For example purposes only, the process 400 references the second vehicle 102*b*, though the process could be carried out by any of the second vehicles 102*b-n*.

The process 400 begins at block 405 where the controller 110 of the second vehicle 102*b* may receive remote vehicle data from at least one of the second vehicles 102*c-n* as well as the first vehicle 102*a*. As explained, the remote vehicle data may include data about the surrounding vehicles 102, such as the current position, speed, and heading.

At block 410, the controller 110 of the second vehicle 102*b* may read map data 410 from the memory 118. The map data may include the current route and road conditions such as the number of lanes and whether pullouts are along the route.

At block 415, the controller 110 of the second vehicle 102*b* may determine whether the map data is available in the memory 118. If so, the process 400 proceeds to block 420. If not, the process 400 proceeds to block 425.

At block 420, the controller 110 of the second vehicle 102*b* may determine whether the map data indicates that the road 104 has a certain lane condition. In one example, the lane condition may be a lane threshold such as a certain number of lanes. In one example, if the road is a two-lane road or less, than the condition may be met. In other examples, any road that could provide less than ideal passing conditions may qualify. If the lane condition is met, the process 400 proceeds to block 430. If not, the process 400 returns to block 405.

In addition to the lane requirement, the controller 110 may also determine whether the map data indicates the presence of a pullout 108 along the route 106 within a predefined pullout distance of the first vehicle 102*a*. The predefined pullout distance may be approximately 5-10 miles.

At block 430, the controller 110 of the second vehicle 102*b* may determine whether the first vehicle 102*a* is within a predefined vehicle distance of the second vehicle 102*b*. The predefined vehicle distance may be approximately 1 mile, for example. If first vehicle 102*a* is within the predefined vehicle distance of the second vehicle 102*b*, the process 400 may proceed to block 435. If not, the process 400 may return to block 405.

At block 435, the controller 110 of the second vehicle 102*b* may determine whether a predefined number of second vehicles 102*b-n* is trailing within the predefined vehicle distance of the first vehicle 102*a*. The predefined number may indicate a number of vehicles creating a back-up queue behind the slow moving first vehicle 102*a*. For example, the predefined number may be three, or more.

If a predefined number of second vehicles 102*b-n* are trailing within the predefined vehicle distance of the first vehicle 102*a*, the process 400 proceeds to block 440. If not, the process 400 returns to block 404.

At block 440, the controller 110 of the second vehicle 102*b* may transmit a request via the V2X communication to the first vehicle 102*a* to issue a pullout advisory.

At block 425, the controller 110 of the second vehicle 102*b* may determine whether the remote vehicle data includes data that indicates a certain lane condition. This may be determined based on data from the sensors 120 and remote vehicle data, as explained above.

Accordingly, the pullout advisory system detects if a slower vehicle is impeding traffic based on the absence of remote vehicles in front of the vehicle within a configurable distance, as well as the presence of a configurable number of trailing remote vehicles within a configurable distance. If speed limit information is available, the application may also consider the speed of the slower vehicle relative to the speed limit.

Further, if the pullout advisory system determines it is on a two-lane road with pullouts and is a slow vehicle impeding traffic based on the above criteria, the system may alert the driver that he or she should use the next available pullout. If the pullout location information is available, the system provides that information to the driver as well.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A route-advisory system for a first vehicle, comprising:

a memory configured to maintain map data indicating at least one road condition;

a controller configured to receive remote vehicle data from at least one other vehicle, the remote vehicle data including a remote vehicle location;

provide route instructions in response to the remote vehicle location indicating that the at least one other vehicle is trailing the first vehicle within a predefined distance and that the at least one road condition indicates the first vehicle and the at least one other vehicle are traveling on a road having a pullout within a predefined distance ahead of the at least one other vehicle, and determine whether the at least one other vehicle is within the predefined distance of the first vehicle in response to the vehicle data indicating the pullout being within a predefined distance ahead of the at least one other vehicle.

2. The vehicle of claim 1, wherein the controller is further configured to provide the route instructions in response to the road condition indicating the road as being a two-lane road.

3. The vehicle of claim 1, wherein the route instructions include instructions for the first vehicle to use the pullout to permit the at least one other vehicle to pass the first vehicle.

4. The vehicle of claim 1, wherein the predefined distance of the pullout is approximately 10 miles.

5. The vehicle of claim 4, wherein the map data is received from the at least one other vehicle in response to map data not indicating the at least one road condition including a number of lanes and a pullout location.

6. The vehicle of claim 1, further comprising a transceiver in communication with the controller and configured to facilitate communication between the first vehicle and the at least one other vehicle, wherein the transceiver is configured to receive the route instructions via a dedicated short-range communication (DSRC) roadside unit (RSU).

7. The vehicle of claim 1, wherein the at least one other vehicle includes a predetermined number of other vehicles and wherein the controller is further configured to provide the route instructions in response to the number of other vehicles exceeding the predetermined number.

8. A route-advisory system for a first vehicle, comprising:

a memory configured to maintain map data indicating at least one road condition; and a controller configured to receive remote vehicle data from at least one other vehicle, the remote vehicle data indicating the presence of another vehicle along the route of the vehicle, and provide route instructions in response to the at least one road condition indicating a pullout located along the route and in response to the at least one other vehicle including a plurality of other vehicles exceeding a predetermined number.

9. The vehicle of claim 8, wherein the controller is further configured to provide the route instruction in response to the pullout being located within a predefined pullout distance of the first vehicle.

10. The vehicle of claim 8, wherein the controller is further configured to provide the route instructions in response to an indication that the first vehicle is traveling below a speed limit of the route.

11. The vehicle of claim 8, wherein the controller is further configured to provide the route instructions in response to route including a road having equal to or less than a predefined number of lanes.

12. The vehicle of claim 11, wherein the predefined number of lanes is two.

13. The vehicle of claim 8, wherein the controller is further configured to provide the route instructions in response to the other vehicle trailing the first vehicle within a predefined vehicle distance along the route.

14. A route-advisory system for a vehicle traveling along a route, comprising:

a memory;

a controller configured to receive map data indicating at least one road condition of the vehicle route;

receive remote vehicle data indicating a presence of at least one other vehicle traveling ahead of the vehicle; and provide route instructions to the other vehicle in response to the map data indicating a pullout along the vehicle route and in response to an indication that the at least one other vehicle is traveling below a speed limit of the route.

15. The system of claim 14, wherein the controller is further configured to provide the route instruction in response to the map data indicating a pullout being located within a predefined pullout distance of the at least one other vehicle.

16. The system of claim 14, wherein the controller is further configured to provide the route instructions in response to the map data indicating the route is along a two-lane road.

17. The system of claim 14, wherein the route instructions include instructions for the at least one other vehicle to use the pullout to permit the vehicle to pass the vehicle.

18. The system of claim 14, wherein the controller is further configured to provide the route instructions in response to the vehicle trailing the at least one other vehicle within a predefined vehicle distance along the route.

* * * * *